United States Patent [19]

Kaelin

[11] Patent Number: 4,899,661

[45] Date of Patent: Feb. 13, 1990

[54] PROJECTILE CONTAINING A FRAGMENTATION JACKET

[75] Inventor: Viktor Kaelin, Einsiedeln, Switzerland

[73] Assignee: Werkzeugmaschinenfabrik Oerlikon-Buehrle AG, Zürich, Switzerland

[21] Appl. No.: 310,314

[22] Filed: Feb. 14, 1989

[30] Foreign Application Priority Data

Feb. 18, 1988 [CH] Switzerland ..... 00597/88

[51] Int. Cl.[4] ..... F42B 13/18

[52] U.S. Cl. ..... 102/495; 102/506; 102/517

[58] Field of Search ..... 102/491, 494, 495, 496, 102/506, 517, 518, 519

[56] References Cited

U.S. PATENT DOCUMENTS

| | | | |
|---|---|---|---|
| 1,197,465 | 9/1916 | Dunwoody | 102/494 |
| 2,401,483 | 6/1946 | Hensel et al. | 102/519 |
| 2,798,431 | 7/1957 | Semon et al. . | |
| 3,425,350 | 2/1969 | Zunino et al. . | |
| 3,532,056 | 10/1970 | Irion | 102/517 |
| 3,977,327 | 8/1976 | Brumfield et al. | 102/494 |

FOREIGN PATENT DOCUMENTS

| | | |
|---|---|---|
| 0163029 | 12/1985 | European Pat. Off. . |
| G8618916.6 | 3/1988 | Fed. Rep. of Germany . |
| 485194 | 3/1970 | Switzerland . |
| 778900 | 7/1957 | United Kingdom . |

*Primary Examiner*—Harold J. Tudor

*Attorney, Agent, or Firm*—Werner W. Kleeman

[57] ABSTRACT

The fragmentation or splintering jacket of a projectile or shell is intended to fracture or disintegrate into a plurality of fragments or splinters of a predetermined size by a bursting or explosive charge located within the fragmentation or splintering jacket. This bursting or explosive charge is detonated by a fuze or detonator at a predetermined or desired moment or burst point. This fragmentation or splintering jacket comprises a plurality of rings provided with reference fracture locations. The fragmentation or splintering jacket fractures or breaks along these reference fracture locations into fragments or splinters of the predetermined size.

1 Claim, 1 Drawing Sheet

PROJECTILE CONTAINING A FRAGMENTATION JACKET

BACKGROUND OF THE INVENTION

The present invention broadly relates to ammunition rounds for weaponry and, more specifically pertains to a new and improved construction of a projectile or shell containing a fragmentation or splintering jacket.

In its more specific aspects, the present invention relates to a new and improved construction of a projectile or shell, also referred to in the art as a missile, comprising a fragmentation or splintering jacket in which a bursting or explosive charge is located, a fuze or detonator for priming or detonating the bursting or explosive charge, and means for fracturing or disintegrating the fragmentation or splintering jacket into fragments or splinters of a predetermined size. The fragmentation or splintering jacket is composed of individual rings or ring members having reference fracture locations. The individual rings positively fracture or break along these reference fracture locations into fragments or splinters of the predetermined or desired size.

Projectiles or shells of this general type are known as disclosed, for instance, in the British Pat. No. 778,900, published July 10, 1957, wherein the projectile also designated as a bomb or grenade contains a high explosive charge. The surface of this explosive charge adjacent the casing or fragmentation jacket is provided with a series of grooves extending longitudinally of the projectile, such grooves being arranged in a suitable pattern in order that the size and shape of the fragments are determined. In particular, the explosive charge is filled into a sleeve made, for example, of paper or thin metal, such sleeve being provided with a number of grooves. The casing or fragmentation jacket can be composed of individual rings which have a smooth finish to the interior surface thereof.

In a further projectile of this general type which is known, for example, from Swiss Pat. No. 485,194, published Mar. 13, 1970, the explosive charge is surrounded or encircled by a foil or sheet which comprises a plurality of lengthwise indentations or recesses extending in the longitudinal direction of the projectile and arranged in rows. The indentations or recesses of neighboring or adjacent rows are staggered with respect to one another in the direction of the rows. Between two such sequentially arranged rows of indentations or recesses there is thus arranged a spacing in which the foil or sheet is flat.

Experience has proven that in the case of heavy metal, the fragmentation or splintering jacket of prior art projectiles or shells cannot be fractured or disintegrated in this manner into fragments or splinters of predetermined or predicted size or magnitude.

SUMMARY OF THE INVENTION

Therefore, with the foregoing in mind, it is a primary object of the present invention to provide a new and improved projectile or shell containing a fragmentation or splintering jacket, which projectile or shell does not exhibit the aforementioned drawbacks and shortcomings of the prior art.

Another and more specific object of the present invention aims at providing a new and improved construction of a projectile or shell containing a fragmentation or splintering jacket which can be positively and reliably fractured or disintegrated by the bursting or explosive charge into fragments or splinters of a predetermined size or magnitude.

A further noteworthy object of the present invention is directed to a new and improved construction of a projectile or shell containing a fragmentation or splintering jacket, which jacket is of relatively simple design and construction, can therefore be relatively economically fabricated, and nonetheless possesses adequate strength to withstand acceleration forces of the projectile or shell as the latter is fired.

Now to implement these and still further objects of the invention which will become more readily apparent as the description proceeds, the projectile or shell containing a fragmentation or splintering jacket as contemplated by the present invention, among other things, is manifested by the features that each individual ring or ring member is subdivided into a plurality of segments which are joined to each other by sintering.

In an advantageous embodiment of the fragmentation or splintering jacket, each individual ring or ring member comprises substantially cylindrical recesses or cut-outs which extend in the longitudinal direction of the projectile or shell and are open toward the interior of the ring or ring member. Each individual ring or ring member can also comprise recesses or cut-outs which possess a substantially triangular cross-section, extend in the longitudinal direction and are open toward the interior of the ring.

In a particularly advantageous embodiment of the splintering or fragmentation jacket constructed according to the teachings of the present invention, and as previously noted each individual ring or ring member is subdivided into a plurality of segments which are joined to each other by sintering.

The formation or provision of reference fracture locations at the fragmentation or splintering jacket has the advantage that such reference fracture locations can be relatively easily and economically fabricated and ensure a positive fracturing or disintegration of the fragmentation or splintering jacket into fragments or splinters or the like of the predetermined or desired size.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
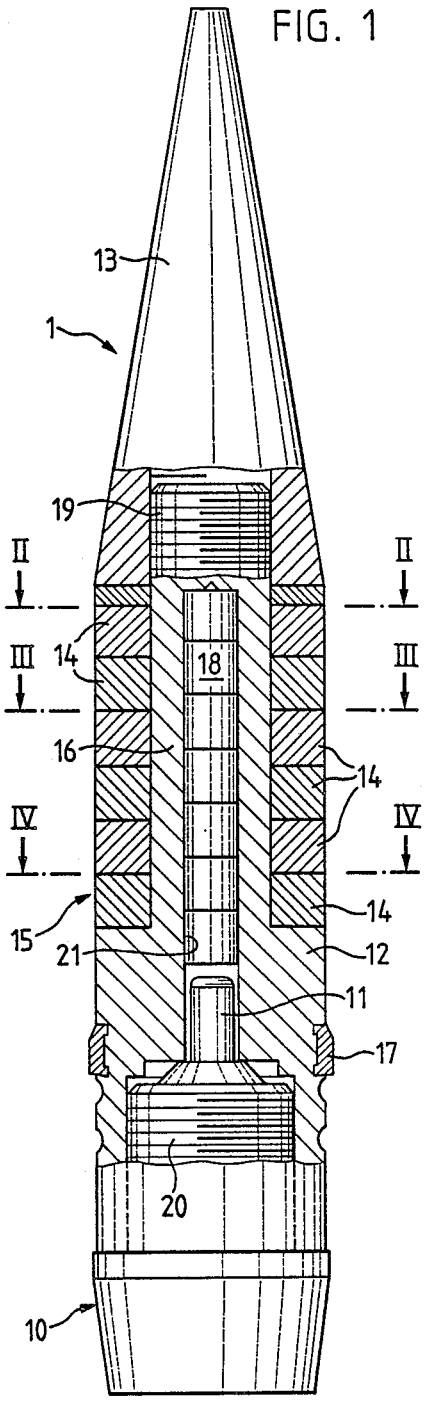
FIG. 1 shows a longitudinal sectional view through a projectile or shell containing a fragmentation or splintering jacket.

Describing now the drawings, it is to be understood that in order to simplify the illustration thereof, only enough of the construction of the exemplary embodiments of a projectile or shell containing a fragmentation or splintering jacket has been shown therein as is needed to enable one skilled in the art to understand the underlying principles and concepts of the present invention. Turning attention now specifically to FIG. 1 of the drawings, a projectile or shell 1 illustrated therein by way of example and not limitation will be seen to comprise a projectile or shell body 12, a hood or cap or cover 13, and a fragmentation or splintering jacket or jacket member 15 made up or composed of a plurality of rings or ring members 14 which are stacked on a mandrel or sleeve 16 of the projectile or shell body 12 and held together by the hood or cap 13.

The projectile or shell 1 further comprises a suitable base fuze or detonator of known construction and generally designated with the reference numeral 10. Before or in the proximity of a target, this fuze or detonator 10 detonates via a booster or booster charge 11 and a bursting or explosive charge 18 located within the projectile or shell 1.

The base fuze or detonator 10 is fastened to the rear or tail end of the projectile or shell body 12 which contains in the interior thereof the booster 11 and the bursting or explosive charge 18. The hood or cap 13 is appropriately fastened to the front or nose end of the projectile or shell body 12.

A guide or drive band 17 or the like anchored at the projectile or shell body 12 transmits to the projectile or shell 1 the spin caused by the helical grooves or rifling or the like of a weapon barrel.

The projectile hood or cap 13 is formed, for example, of a plastic material or a light metal alloy. An aluminum alloy having the designation Al, 6Zn, Mg, 1.5Cu is particularly suitable as the light metal or alloy, wherein the numerical values are each in percent by weight. The hood or cap 13 is screwed on or threaded to the projectile shell or body 12 by means of a thread 19 or the like or can be fastened in any other suitable manner to the projectile or shell body 12.

The projectile or shell body 12 is also fabricated or formed of a light metal alloy, especially of an aluminum alloy designated as Al, 6Zn, Mg, 1.5Cu. The projectile or shell body 12 comprises, at the front or nose end thereof, the aforementioned thread 19 for securing the projectile hood or cap 13 and, at the rear or tail end thereof, a second thread 20 for securing the base fuze or detonator 10. In the mandrel or sleeve 16 of the projectile or shell body 12 there is provided a bore 21 for receiving or accommodating the bursting or explosive charge 18.

The bursting or explosive charge 18 is made up, in known manner, of a plurality of substantially cylindrical bodies or parts which, in particular, are fabricated of Hexal W15.

As hereinbefore mentioned, the base fuze or detonator 10 and the booster 11 are known per se and are therefore not here further described. The fragmentation or splintering jacket 15 is made up or composed of, for example, six rings or ring members 14, the number of rings 14 being of no specific importance or criticality. Such rings 14 are preferably made of sintered metal, particularly heavy metal such as, for example, an alloy of the composition W, 4.5Ni, Fe, wherein the numerical value is given in percent by weight. It is essential that the rings 14 of the fragmentation or splintering jacket 15 comprise reference fracture locations in order that the rings 14 fracture or disintegrate into fragments or splinters of predetermined size upon detonation of the bursting or explosive charge 18. Such reference fracture locations can possess a variety of shapes.

Figure 2:
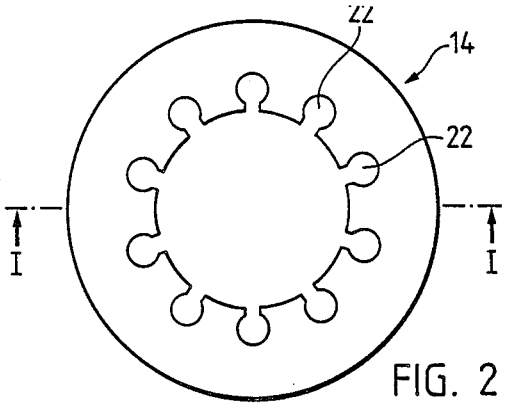
FIG. 2 is a cross-section along the line II—II in FIG. 1, showing a first embodiment of a ring or ring member of the fragmentation or splintering jacket.

As depicted in the embodiment of FIG. 2, the ring 14 is provided with substantially cylindrical recesses or cut-outs 22 which are open toward the interior of the associated ring 14 and extend in the longitudinal direction.

Figure 3:
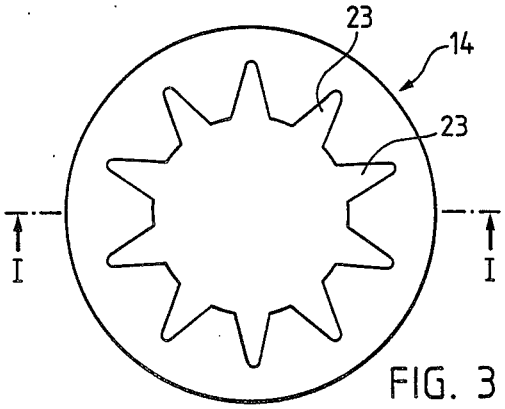
FIG. 3 is a cross-section along the line III—III in FIG. 1, showing a second embodiment of a ring or ring member of the fragmentation or splintering jacket.

In the modified embodiment of FIG. 3 the ring 14 is provided with recesses or cut-outs 23 having a substantially triangular cross-section and extending in the longitudinal direction. These recesses or cut-outs 23 are open toward the interior of the ring 14.

Figure 4:
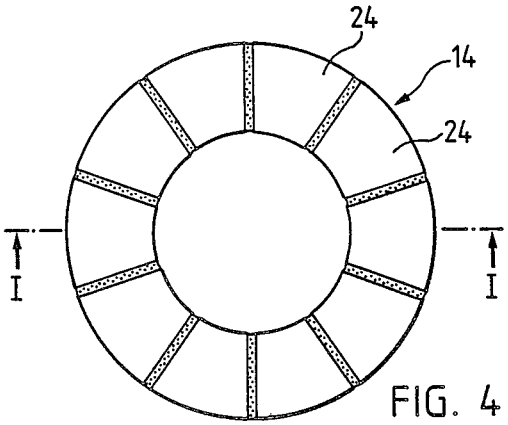
FIG. 4 is a cross-section taken substantially along the line IV—IV in FIG. 1, showing a third embodiment of a ring or ring member of the fragmentation or splintering jacket.

Finally, as depicted in the preferred embodiment of FIG. 4, the ring or ring member 14 is subdivided into a plurality of individual segments or segment members or pieces 24 which are joined to each other by sintering.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A projectile containing a fragmentation jacket, comprising:

an explosive charge located within said fragmentation jacket;

a fuze for detonating said explosive charge;

means for fracturing said fragmentation jacket into splinters of a predetermined size;

said fragmentation jacket comprising:

a hollow mandrel containing a bore within which there is received said explosive charge;

a plurality of individual rings defining said fracturing means;

each of said individual rings comprising individual segments assembled together to form each said ring;

each of said individual rings being stacked upon said mandrel;

each of said individual rings containing means defining reference fracture locations;

each of said individual rings fracturing along said reference fracture locations into said splinters of said predetermined size;

the individual segments of each individual ring comprising sintered interconnected segments for forming the corresponding individual ring; and a projectile hood secured to said mandrel for holding together said plurality of individual rings.

* * * * *